US010086414B2

(12) United States Patent
Høxbroe

(10) Patent No.: US 10,086,414 B2
(45) Date of Patent: Oct. 2, 2018

(54) MONITORING OF SYSTEMS FOR INTERNAL CLEANING OF CONTAINERS

(71) Applicant: ALFA LAVAL CORPORATE AB, Lund (SE)

(72) Inventor: Denniz Høxbroe, Jyllinge (DK)

(73) Assignee: ALFA LAVAL CORPORATE AB, Lund (SE)

( * ) Notice: Subject to any disclaimer, the term of this patent is extended or adjusted under 35 U.S.C. 154(b) by 894 days.

(21) Appl. No.: 14/377,729

(22) PCT Filed: Feb. 12, 2013

(86) PCT No.: PCT/EP2013/052769
§ 371 (c)(1),
(2) Date: Aug. 8, 2014

(87) PCT Pub. No.: WO2013/120841
PCT Pub. Date: Aug. 22, 2013

(65) Prior Publication Data

US 2016/0008859 A1 Jan. 14, 2016

(30) Foreign Application Priority Data

Feb. 13, 2012 (EP) ..... 12155043

(51) Int. Cl.
*B08B 9/093* (2006.01)
*B08B 13/00* (2006.01)
(Continued)

(52) U.S. Cl.
CPC ..... *B08B 9/0936* (2013.01); *B05B 3/06* (2013.01); *B05B 3/066* (2013.01); *B05B 12/004* (2013.01); *B08B 13/00* (2013.01); *B05B 13/0636* (2013.01)

(58) Field of Classification Search
None
See application file for complete search history.

(56) References Cited

U.S. PATENT DOCUMENTS 2,035,962 A * 3/1936 Hock ..... C12C 3/08 126/343.5 A
5,333,630 A 8/1994 Jepsen et al.
(Continued)

FOREIGN PATENT DOCUMENTS

CN 1615429 A 5/2005
DE 10 2006 034882 B3 10/2007
(Continued)

OTHER PUBLICATIONS

English Machine Translation of EP 1882914 A2.*
"Instruction Manual, Toftejorg Sanitary Rotacheck System, Ex for Toftejorg TJ20G/TZ-74/TZ-79/TZ-89" TIM-TE91A661-EN032, (Alfa Laval Toftejorg), month and year of publication unknown (publication obtained before Feb. 2012), pp. 1-4.
(Continued)

*Primary Examiner* — Nicole Blan
(74) *Attorney, Agent, or Firm* — Buchanan Ingersoll & Rooney PC

(57) ABSTRACT

A monitoring arrangement monitors the operation of a cleaning-in-place system which is operable to remove contaminations, deposits and other impurities from the internal walls of a container. The CIP system comprises a pipe for extending into the container through a wall portion of the container, and a nozzle head for ejecting liquid into the container in a predetermined pattern. The monitoring arrangement comprises a sensor unit with a sensing surface responsive to liquid impact for enabling the sensor unit to emit a sensor signal indicative of the liquid impact. The sensing surface is elongated and configured to extend along a perimeter of the pipe when the sensor unit is mounted at the wall portion of the container. This enables improved performance of a processing unit that obtains and processes the sensor signal for monitoring the operation of the CIP system.

17 Claims, 4 Drawing Sheets

(51) Int. Cl.

| | |
|---|---|
| ***B05B 3/06*** | (2006.01) |
| ***B05B 12/00*** | (2018.01) |
| ***B05B 13/06*** | (2006.01) |

(56) References Cited

U.S. PATENT DOCUMENTS

| | | | |
|---|---|---|---|
| 5,715,852 | A | 2/1998 | Jepsen |
| 2003/0137895 | A1 | 7/2003 | Hummer |

FOREIGN PATENT DOCUMENTS

| | | | |
|---|---|---|---|
| EP | 1 882 914 | A2 | 1/2008 |
| JP | 8-192125 | A | 7/1996 |
| JP | 2008-290003 | A | 12/2008 |
| WO | 03/089883 | A1 | 10/2003 |

OTHER PUBLICATIONS

Troy R. Humphries, "Transportation, Storage, and Process", Tank Cleaning Technology, Version: 456B, (May 30, 2006), pp. 1-19.

International Search Report (PCT/ISA/210) dated Mar. 5, 2013, by the European Patent Office as the International Searching Authority for International Application No. PCT/EP2013/052769.

Written Opinion (PCT/ISA/237) dated Mar. 5, 2013, by the European Patent Office as the International Searching Authority for International Application No. PCT/EP2013/052769.

Search Report dated Aug. 1, 2012, by the European Patent Office for Application No. 12155043.8.

Anonymous: "Edelstahl-Reinigungstechnik [7. Auflage]: CIP-Monitoring System (CIPMon SC)", Armaturenwerk Hötensleben catalogue, Nov. 2006, pp. 1, 98-100, XP002680355, retrieved from the internet: URL:http://www.awh.de/pdf/deutsch/AWH-RT7-1106-dt.pdf.

* cited by examiner

MONITORING OF SYSTEMS FOR INTERNAL CLEANING OF CONTAINERS

TECHNICAL FIELD

The present invention relates to systems for internal cleaning of containers, and in particular to techniques for monitoring the operation of such cleaning systems.

BACKGROUND

In many processing applications, e.g. for production of chemicals, foodstuffs and pharmaceutical compounds, containers or tanks are used for storing or processing various ingredients. These containers need to be cleaned from time to time. The need for cleaning may be controlled by many different factors, depending on industry and type of processing, e.g. to avoid cross contamination, adulteration and avoidable carryover, to prepare the container for processing of another batch, to remove or at least avoid build up of contamination layers such as bio-film, dried foam, precipitate or sediments, to comply with legal requirements, to prepare the container for human entry, to remove hazardous or explosive atmospheres, or to protect the processing equipment against corrosion or other degradation.

Such a need for internal cleaning of containers arises in all types of industries, including the fields of pharmaceutics, food processing, textiles, pulp and paper, paint, petrochemical processing, plastics, mining, etc. It is desirable to clean the containers as fast and efficient as possible, preferably without having to dismantle and clean the containers manually. There is also a general desire to reduce the consumption of water, chemicals and energy. To achieve one or more of these goals, so-called Cleaning-In-Place (CIP) systems have been developed. The CIP systems operate to supply a fluid inside the tank for cleaning purposes and may be either static or rotary.

A static CIP system may use a static spray ball inside the container to spray a chemical detergent onto the interior of the container, whereby the mechanical action of falling film acts to remove contaminations.

A rotary or dynamic CIP system may operate a rotary nozzle head to rotate slowly inside the container so as to generate and displace one or more fluid jets or sprays across the inner surfaces of the container, whereby the impact of the fluid at least partly acts to remove contaminations. In one type of rotary CIP system, the nozzle head is configured to generate confined liquid jets that are rotated both around a vertical axis in the container and a second axis with respect to the nozzle head, e.g. as disclosed in U.S. Pat. No. 5,333,630 and U.S. Pat. No. 5,715,852. Such a nozzle head is known as a "rotary jet head" (RJH) and operates to move the jet in mutually displaced loops on the inside the container, such that the loops collectively form a full pattern with desired coverage. In another type of rotary CIP system of simpler design, the nozzle head is configured to generate one or more sprays of fan-shaped flat type which are rotated around a vertical axis in the container, e.g. as disclosed in US2003/137895. Such a nozzle head is known as a "rotary spray head" (RSH).

Typically, CIP systems are highly automated, and there is a need to ensure proper cleaning of the container. For verification that the container is properly cleaned, the interior of the container may be physically inspected. This is however a labor intensive and expensive process.

A commercially available system for monitoring of an RJH CIP system is denoted "Rotacheck system" and provided by Alfa Laval. The Rotacheck system may be used for e.g. automatically estimating whether the interior of the container has been properly cleaned or not. The system includes a sensor which is installed in the roof of the container and has a small circular sensor diaphragm that generates a signal pulse when hit by a jet released by the rotary jet head. By evaluating the timing of signal pulses, the system is able to verify proper rotation of the rotary jet head. Since the RJH CIP system moves the jet slowly in mutually displaced loops, the time interval between signal pulses generated by the sensor for a particular jet may be significant, e.g. on the order of minutes, or even longer. Apart from causing an undesired delay in detecting e.g. malfunctions in the RJH CIP system, the long time interval between signal pulses causes an undesirable trade-off between response time and accuracy in detecting malfunctions. A fast response time may require a potential malfunction to be detected based on a single or a few signal pulses for a particular jet, resulting in a low accuracy and a risk for errors. The long time intervals also make the monitoring system vulnerable to interferences, e.g. caused by liquid splashes, measurement noise, and instabilities in the level of signal pulses, etc.

The prior art also comprises JP08-192125, which discloses a rotary CIP system that operates to rotate a spray ball around a vertical axis inside a tank, while the ball ejects a liquid through a series of holes to generate a 360° spray in a vertical plane. Poor rotation of the spray ball is detected based on signals from two spaced apart circular sensors arranged in the roof of the tank to measure pH, temperature or electric conductivity. This monitoring technique is sensitive to wetting of the sensors, splashes, etc.

JP2008-290003 discloses a rotary CIP system that comprises a rotary jet generation element which is suspended from the roof of a tank to generate a rotating jet of liquid. A conductivity sensor is suspended from the roof in parallel to the jet generation element so as to be intermittently hit by the rotating jet. A rotation failure may be detected by correlating the rotation of the jet generation element with the output signal of the conductivity sensor. This monitoring technique is sensitive to wetting of the sensor, splashes, etc. The use of a projecting sensor may limit the installation to certain types of tanks or applications, and may also lead to undesired accumulation of contaminations on the sensor itself.

SUMMARY

It is an objective of the invention to at least partly overcome one or more limitations of the prior art.

Another objective is to provide an improved technique for monitoring of rotary CIP systems for the purpose of identifying operation failure and/or verifying proper cleaning.

A further objective is to enable a faster and/or more accurate detection of operation failure in a rotary CIP system.

Yet another objective is to provide a monitoring technique which is simple to install in containers and/or combine with rotary CIP systems.

A still further objective is to provide a monitoring technique capable of providing increased information about the cleaning process inside the container.

One or more of these objects, as well as further objects that may appear from the description below, are at least partly achieved by means of a monitoring arrangement, a cleaning system, method of monitoring the operation of a cleaning system, and a computer program product according to the independent claims, embodiments thereof being defined by the dependent claims.

A first aspect of the invention is a monitoring arrangement for a cleaning system installed in a container, the cleaning system comprising a pipe configured to extend into the container through a wall portion of the container, a nozzle head connected for rotation at an end of the pipe inside the container so as to eject a liquid, and a drive member operable to impart a rotation to the nozzle head around a first axis such that the liquid is ejected into the container in a predetermined pattern. The monitoring arrangement comprises a sensor unit for mounting at the wall portion of the container, the sensor unit comprising a sensing surface responsive to liquid impact for enabling the sensor unit to emit a sensor signal indicative of the liquid impact; and a processing unit configured to obtain the sensor signal from the sensor unit and process the sensor signal for monitoring the operation of the cleaning system. According to the first aspect, the sensing surface is elongated and configured to extend along a perimeter of the pipe when the sensor unit is mounted at the wall portion of the container. By "elongated" means that the sensing surface has a greater dimension (surface extension) in one direction across the sensing surface than another dimension (surface extension) in another direction across the sensing surface. By "sensing surface" means the surface of the sensor unit that is responsive to liquid impact, i.e. the sensor unit emits a signal when liquid impact on the sensing surface.

The inventive configuration of the sensor unit allows the sensing surface to be selectively extended in a direction that coincides with one or more movement trajectories for the ejected liquid in the predetermined pattern. For example, the sensing surface may be extended to approximately coincide with the direction of movement of the nozzle head around the first axis. The elongated extent of the sensing surface may thereby cause the ejected liquid, be it a confined jet or a flat-fan spray, to move across the sensing surface during a longer time period when it impinges on the sensor unit during the cleaning process. Generally, the longer duration provides an improved ability of tracking the ejected liquid as a function of time. The longer duration of liquid impact may be used to improve the accuracy of the monitoring. For example, the longer duration may be converted into a more consistent signal pulse in the sensor signal and/or or be used for suppressing the influence of fluctuating interferences such as splatter. If the sensor unit is made sensitive to the location of liquid impact within the elongated sensing surface, the first aspect may also enable time-resolved monitoring of the ejected liquid while it is moved across the sensing surface, as well as two-dimensional monitoring of the distribution of liquid impact across the sensing surface. This may enable determination of novel monitoring parameters, such as the width (footprint) of the ejected liquid, which may provide additional information about the cleaning process.

When the ejected liquid is a confined jet that is rotated both around the first axis and a second axis defined in relation to the nozzle head, e.g. as described above for so-called RJH CIP systems, the extended sensing surface may increase the frequency by which the jets impinge on the effective sensing area. This will reduce the time interval between liquid impact on the sensor unit, and thereby enable a faster and/or more accurate detection of operation failure. The reduced time interval may also result in an increased amount of information about the cleaning process, e.g. by an increased time-resolution of a monitoring parameter.

The sensor unit may be configured for installation in any container, since it need not (but may) project into the container. The sensor unit is simple to install since it may be arranged in a through hole or a blind hole in the wall portion. The sensor unit may also be combined with the cleaning system, e.g. by arranging the sensor unit in a mounting flange attached to the pipe, where the mounting flange is configured to be fitted in sealing engagement with an opening in the wall portion of the container.

In certain cleaning systems, the first axis may be arranged to co-extend with the longitudinal axis of the pipe, or even coincide with a longitudinal center axis of the pipe. In other cleaning systems, the first axis may have an inclination with respect to the longitudinal axis, e.g. in the range of approximately ±20° or ±10°.

According to the first aspect, the sensing surface is elongated to extend along the perimeter of the pipe, which denotes the outer contour of the pipe. This is merely intended to indicate that the sensing surface spans along at least a portion of the outer contour of the pipe, with or without a spacing to the outer contour.

In one embodiment, the sensing surface is configured to extend along at least 25%, 50% or 75% of the perimeter of the pipe. This corresponds to a span of at least 90°, 180° or 270° of the outer contour of the pipe. It is currently believed that an increased span yields improved performance in terms of accuracy, and may also improve the ability of extracting novel monitoring parameters.

In one embodiment, the sensing surface is configured to surround the pipe when the sensor unit is mounted at the wall portion of the container. Thereby, the sensing surface spans 360° of the outer contour of the pipe. The shape of the sensing surface that surrounds the pipe may be optimized depending to the cleaning system and/or the monitoring parameters to the extracted from the sensor signal. Thus, the shape of the sensing surface may but need not conform to the outer contour of the pipe.

In one embodiment, the sensing surface is annular, with any desired shape of the annulus, including circular, elliptical, and polygonal.

In one embodiment, the sensing surface is configured to extend along an essentially circular path around the pipe when the sensor unit is mounted at the wall portion of the container. The use of a circular path may, at least for certain cleaning systems, optimize the duration of liquid impact on the sensing surface, and may also facilitate the interpretation of the sensor signal.

The sensing surface may be configured as a coherent surface, which is thus responsive to liquid impact across its entire extent.

In a variant, the sensing surface may be formed as an aggregation of individual sensing segments, which are individually responsive to liquid impact. The sensor signal may thus comprise sub-signals indicative of the liquid impact on the respective segments. The sensing segments may be arranged to form a coherent surface, or they may be arranged with a mutual spacing along the elongated extent of the surface portion. This means that the sensing surface may include surface portions that are not responsive to liquid impact. It should be understood that even if it includes non-responsive surface portions, the sensing surface may still be continuous or coherent with respect to the impinging liquid, provided that the non-responsive surface portions have an extent that is less than a relevant dimension of the impinging liquid on the sensor unit, e.g. the minimum diameter of a confined jet or the width of a flat-fan spray as it impinges on the sensor unit. This enables the sensor unit to be responsive to impact from the ejected liquid across the entire sensing surface.

In one embodiment, the processing unit is configured to process the sensor signal so as to identify occurrences of liquid impact on the sensing surface and match the occurrences to the predetermined pattern. This enables the monitoring arrangement to verify proper functioning of the cleaning system and to identify malfunctions, e.g. in the rotation of the nozzle head, or the operation of a specific nozzle.

In one embodiment, the sensor unit is configured to be responsive to the location of liquid impact within the sensing surface, and the processing unit is configured to process the sensor signal to determine a distribution of liquid impact on the sensing surface. This enables the monitoring arrangement to track the movement of the ejected liquid and/or to determine novel monitoring parameters, such as width or pressure of the ejected liquid.

In one embodiment, the nozzle head of the cleaning system is configured to rotate at least two jets of liquid around the first axis and around a second axis of the nozzle head, and the processing unit is configured to monitor at least one of: a dimension of each jet, the number of jets, a pressure of each jet, the rotation of the jets around the first axis, and the rotation of the jets around the second axis.

In another embodiment, the nozzle head of the cleaning system is configured to rotate at least one beam of liquid around the first axis, and the processing unit is configured to monitor at least one of: a dimension of said at least one beam of liquid, the rotation of said at least one beam of liquid around the first axis, and a pressure of said at least one beam of liquid. The cleaning system may be configured to generate the beam of liquid in the form of a collimated jet or an expanding beam, also known as a fan beam, which may or may not be of a flat type.

In one embodiment, the processing unit is configured to process the sensor signal for determination of a value of at least one monitoring parameter indicative of the ejected liquid, evaluate the value of said at least one monitoring parameter for detection of a malfunction in the cleaning system, and issue a warning signal indicative of the malfunction.

In one embodiment, the processing unit is configured to record data representative of the predetermined pattern based on the sensing signal, and to generate a validation report based on the recorded data.

A second aspect of the invention is a cleaning system for installation in a container, wherein the cleaning system comprises a pipe extending into the container through a wall portion of the container, a nozzle head connected for rotation at an end of the pipe inside the container so as to eject a liquid into the container, and at least one drive member operable to impart a rotation to the nozzle head around a first axis such that the liquid is ejected into the container in a predetermined pattern, the cleaning system further comprising the monitoring arrangement of the first aspect.

A third aspect of the invention is a method of monitoring the operation of a cleaning system which comprises a pipe extending into a container through a wall portion of the container, a nozzle head connected for rotation at an end of the pipe inside the container so as to eject a liquid, and a drive member operable to impart a rotation to the nozzle head around a first axis such that the liquid is ejected into the container in a predetermined pattern. The method of the third aspect comprises the steps of: obtaining a sensor signal from a sensor unit which comprises an elongated sensing surface that is responsive to liquid impact, said sensor unit being mounted at the wall portion of the container such that the elongated sensing surface extends along a perimeter of the pipe; and processing the sensor signal for monitoring the operation of the cleaning system.

A fourth aspect of the invention is a computer program product comprising computer code which, when executed on a data-processing system, is adapted to carry out the method of the third aspect.

Any one of the embodiments of the first aspect can be combined with the second to fourth aspects to attain the corresponding technical effects or advantages.

Still other objectives, features, aspects and advantages of the present invention will appear from the following detailed description, from the attached claims as well as from the drawings.

BRIEF DESCRIPTION OF DRAWINGS

Embodiments of the invention will now be described in more detail with reference to the accompanying schematic drawings.

DETAILED DESCRIPTION OF EXAMPLE EMBODIMENTS

Figure 1:
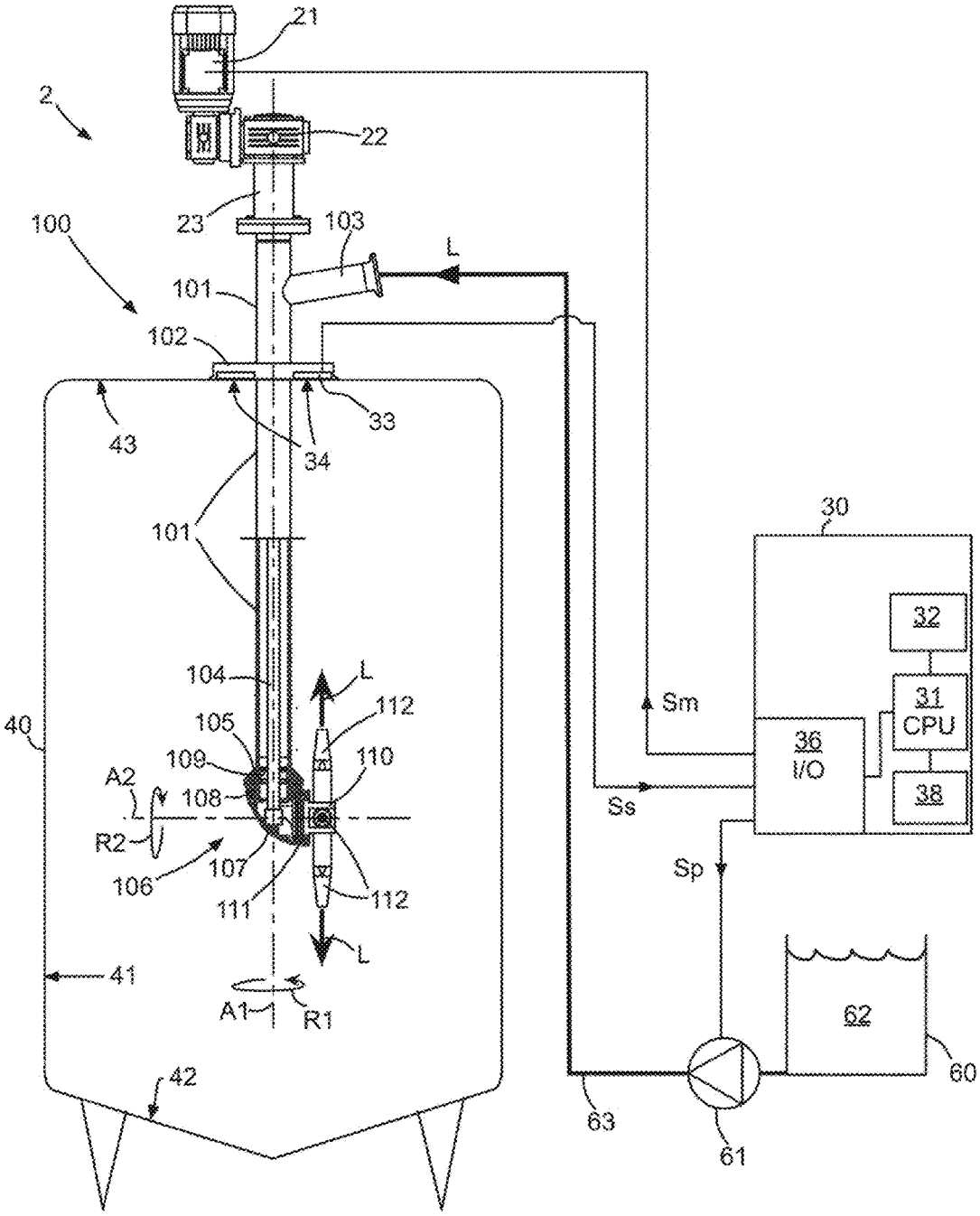
FIG. 1 is a side view, partly in section, of a cleaning system of RJH type as installed in a container, in association with an embodiment of an inventive monitoring arrangement.

Embodiments of the present invention relate to techniques for remote monitoring of a cleaning process performed by a rotary CIP system inside a container. In the following, examples are given with respect to a rotary CIP system of RJH type (rotary jet head) as well as a CIP system of RSH type (rotary spray head). Corresponding elements are designated by the same reference numerals.

FIG. 1 illustrates an exemplifying cleaning system 2 of RJH type. The cleaning system 2 is configured to eject jets of a liquid L inside a container 40 for the purpose of cleaning its interior, e.g. the circumferential side wall 41, the bottom wall 42 and the top wall 43. The system 2 is typically, but not necessarily, operated when the container 40 is empty or at least sufficiently empty for the cleaning process to be effective. The system 2 comprises a distributor 100, at least one drive member 21, 109 for the distributor 100, and a processing unit 30 that is configured to control the drive member 21, 109 and thereby how the jets of liquid L are ejected from the distributor 100 onto the walls 41-43 of the container 40 in a predetermined pattern.

In the illustrated example, the distributor 100 has a pipe 101 that extends into the container 40 via an opening in the top wall 43 of the container 40. The distributor 100 has a mounting flange 102 that provides a secure connection as well as a tight seal to the container 40. An upper part of the pipe 101 that is outside the container 40 has an inlet 103 for receiving a liquid L. A lower part of the pipe 101 that extends into the container 40 has at its end a connection flange 105 to which a rotary head 106 is connected. The rotary head 106 comprises a housing 107 that is rotatable around a first axis A1 that is parallel to the pipe 101. A first bearing 108 is arranged in between the connection flange 105 and an inlet end of the housing 107 that faces the connection flange 105, such that the housing 107 is rotatable relative the connection flange 105. The rotary head 106 also comprises a rotary hub or nozzle head 110 on which a number of liquid ejection nozzles 112 are arranged. In the illustrated embodiment, four nozzles are symmetrically arranged on the rotary hub 110 even though it is possible to have any number of nozzles, e.g. only one nozzle, on the rotary hub 110. A second bearing 111 is arranged in between the rotary hub 110 and an outlet end of the housing 107 that faces the rotary hub 110, such that the rotary hub 110 is rotatable relative the housing 107. The second bearing 111 allows the rotary hub 110 to rotate about a second axis A2 that is typically offset from the first axis A1 by an angle of 80-100° (90° in the illustrated embodiment). Thus, the rotary hub 110 and the nozzles 112 are able to rotate in a first direction R1 about the first axis A1 and in a second direction R2 about the second axis A2. In certain embodiments, not shown, the first axis A1 may be inclined with respect to the axis of the pipe 101.

The inlet 103 and the pipe 101 each have the principal shape of a conventional pipe and are capable of transporting liquid L to be ejected into the container 40. Liquid L enters the inlet 103, is conveyed into the pipe 101 and towards the rotary head 106. Liquid L then enters the housing 107 of the rotary head 106 at its connection to the connection flange 105 and exits the housing 107 at its connection to the rotary hub 110. The rotary hub 110 receives liquid from the housing 107 and distributes liquid L further to the nozzles 112, which eject the liquid L into the container 40 such that liquid L hits the inner walls 41-43 of the container 40.

The rotation in the first direction R1 about the first axis A1 is accomplished via a transmission shaft 104 that extends from an upper end of the pipe 101 and to the rotary head 106 where it is connected to the housing 107. The shaft 104 has a diameter that is smaller than both an inner diameter of the pipe 101, an inner diameter of the connection flange 105 and a diameter of an opening at the inlet end of the housing 107. This allows liquid L to flow past the shaft 104. When the shaft 104 is rotated, the housing 107 and thereby the rotary head 106 are rotated in the first direction R1. The pipe 101 is connected to a connection piece 23 and a gearbox 22 is connected to the connection piece 23. The shaft 104 is connected to the gearbox 22, which in turn is connected to a drive member 21. The drive member 21 is here a conventional electrical motor 21, but other types of motors such as a pneumatic motor may be used just as well. When the motor 21 is activated, it generates a rotation of the shaft 104 and thereby a rotation of the rotary head 106 in the first direction R1.

To accomplish the rotation in the second direction R2, a drive member 109 in form of an impeller 109 is arranged inside the housing 107. A rotation of the impeller 109 is induced by a flow of liquid L that passes through the housing 107, from the inlet end to the outlet end of the housing 107. When the impeller 109 rotates, its rotational movement is used for generating a rotation of the rotary head 106, or more specifically, for generating a rotation of the rotary hub 110 in the second direction R2.

Thus, in the example of FIG. 1, the motor 21 and the impeller 109 form a drive member or drive means 21, 109 that provides the rotations in the first direction R1 and in the second direction R2. It should be emphasized that FIG. 1 is merely given as an example. In alternative designs, the rotation of the rotary head 106 in the first direction R1 may instead be provided by the flow of liquid L, e.g. via a dedicated impeller, and/or a dedicated motor may be coupled to the rotary hub 110 via a transmission to impart the rotation of the rotary hub 110 in the second direction R2.

In FIG. 1, the cleaning system 2 is connected to a supply system which includes a supply 60 of a cleaning liquid 62, and a pump 61 for pumping the cleaning liquid from the supply 60 through a connection line 63 that extends from the pump 61 to the inlet 103. The pump 61 may be e.g. a gear pump, a lube pump, a centrifugal pump or a pump of another suitable type. The cleaning liquid may be any type of liquid, which may or may not include a detergent. During a cleaning process, cleaning liquid may in a conventional manner be recirculated via a return line (not shown) that is connected between a bottom of the container 40 and the inlet 103.

Figure 2A:
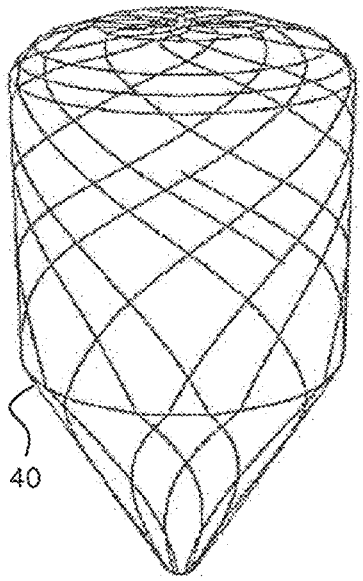
FIGS. 2A-2C illustrate a predetermined pattern of ejected liquid as generated by the cleaning system in FIG. 1 at three consecutive time points.
Figure 2B:
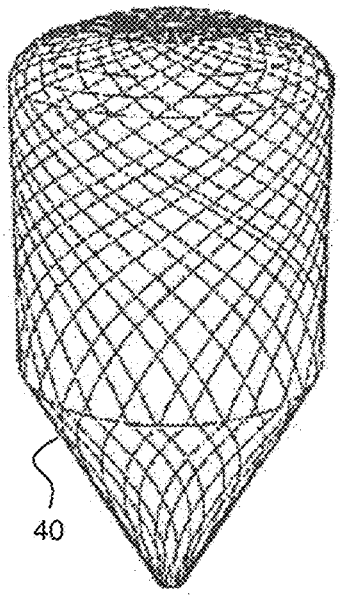
Figure 2C:
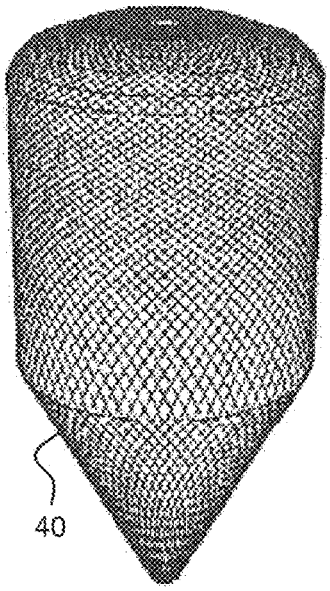

In FIG. 1, the processing unit 30 is electrically connected to the cleaning system 2 to control the drive member 21, 109 by means of a respective control signal Sm and Sp. The processing unit 30 may thereby control the cleaning system 2 to direct the jets of liquid in a predetermined pattern across the interior of the container 40. The generation of the predetermined pattern is illustrated in FIGS. 2A-2C. In the illustrated example, the rotation speed of the rotary hub 110 around axis A2 is adapted to the rotation speed of the rotary head 106 around axis A1, so as to control the jets to generate a number of mutually displaced loops on the inner walls of the container 40. After a given number of revolutions of the rotary head 106, a so-called full pattern is formed, whereupon the cleaning system 2 may be controlled to proceed with another full pattern or to discontinue the cleaning process. The generation of the full pattern is typically a slow process, since the rotary head 106 and rotary hub 110 are rotated slowly to achieve proper cleaning. As an example, the coarse pattern in FIG. 2A may be achieved after 1 minute, the denser pattern in FIG. 2B after 2.5 minutes, and the full pattern in FIG. 2C after 7 minutes.

Reverting to the example in FIG. 1, the processing unit 30 has a central processing unit 31 (CPU) that is connected to and controls an electronic input/output interface 36 (I/O). The I/O interface 36 is in turn electrically connected to the motor 21 and to the pump 61 to provide the control signals Sm and Sp. The CPU 31 is a central processing unit or microprocessor of a conventional type and represents the portion of the processing unit 30 that is capable of carrying out instructions of a computer program which is stored in a memory 32 of the unit 30. The CPU 31 is the primary element carrying out the functions of the unit 30. The unit 30 further includes a user interface 38 that allows an operator to input operation parameters, and/or that allows the unit 30 to output information about the progress of the cleaning process to the operator. This information may at least partly be computed by the unit 30, by processing a sensor signal Ss which is acquired via the I/O interface 36 from a dedicated sensor unit 33 in the container 40.

Figure 3:
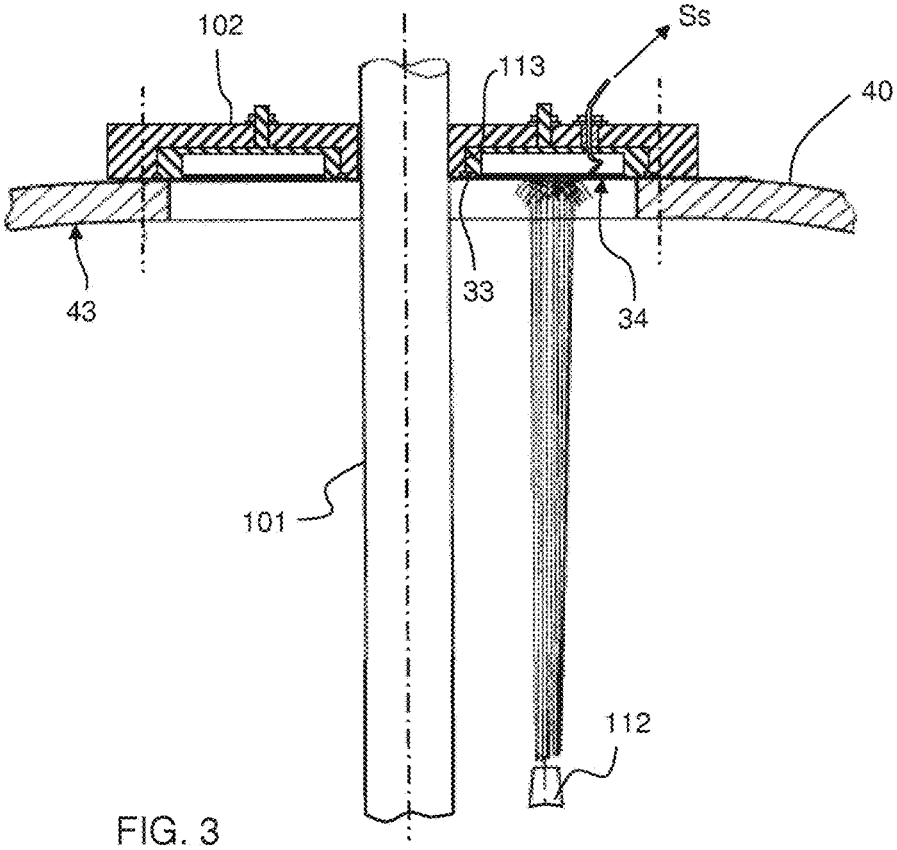
FIG. 3 is an enlarged view of a sensor unit included in the monitoring arrangement of FIG. 1.

As shown in further detail in FIG. 3, the sensor unit 33 is fitted in and attached to a recess 113 in the flange 102 of the cleaning system 2. When the cleaning system 2 is mounted to the container 40, the sensor unit 33 defines a ring-shaped sensing surface 34 that faces the interior of the container 40 and is arranged to be intermittently struck by the jets that are emitted by the nozzles 112 during rotation of the rotary head 106 and the rotary hub 110.

Figure 4:
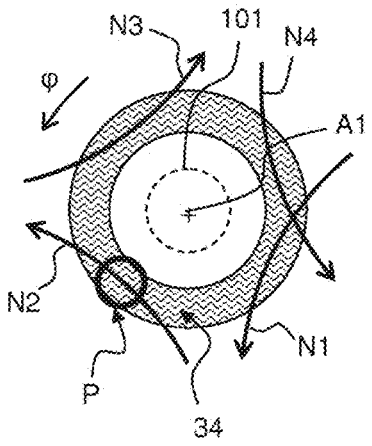
FIG. 4 is a plan view of a sensing surface of the sensor unit in FIG. 3 and indicates impact paths for liquid jets across the sensing surface during generation of a predetermined pattern of ejected liquid.

FIG. 4 is a plan view of the sensing surface 34 as seen from a position directly beneath the sensor unit 33 in the container 40, while omitting all parts of the cleaning system 2 for clarity of presentation. As seen, the sensing surface 34 is configured as an annular, continuous surface that surrounds the outer perimeter of the vertical pipe 101 (indicated by dashed lines) and the first axis A1, and is denoted a "ring sensor" in the following. To explain the technical advantage of ring sensor 34, FIG. 4 also illustrates four jet paths N1-N4 that are traced across the roof portion 43 of the container 40, and thus across the ring sensor 34, during a single revolution of the rotary hub 110 on the rotary head 106, which rotates around axis A1. Each of the jet paths N1-N4 originate from a different nozzle 112 on the rotary hub 110. As shown, the ring sensor 34 is arranged with a spacing to the outer perimeter of the pipe such that the trajectories of the impinging jets, exemplified by paths N1-N4, fall on the ring sensor 34. For comparison, FIG. 4 also indicates the placement and extent of a single conventional pressure sensor P, as discussed in the Background section. It should be understood that the conventional sensor P will be hit by a jet from each nozzle much fewer times, more or less vaguely, during generation of a full pattern of ejected liquid.

Figure 5:
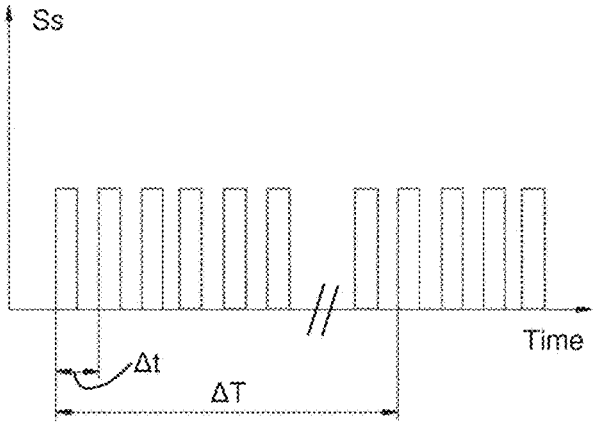
FIG. 5 is a timing diagram illustrating the occurrence of signal pulses in a sensor signal acquired from the sensor unit in FIG. 3.

In many implementations, only the exact hits will result in sufficiently reliable and consistent signal pulses, which means that proper operation of the nozzles may only be verified once for every full pattern, e.g. once every 7 minutes, using the conventional sensor P. On the other hand, as indicated in FIG. 4, the ring sensor 34 will be hit by a jet from each nozzle 112 each time the nozzle 112 is directed towards the roof 43, which normally occurs once during each revolution of the rotary hub 110. In a typical example, the sensing ring 34 will be hit by a jet 152 times during a full pattern, which means that the sensor signal Ss will contain 38 signal pulses from each nozzle, corresponding to a time difference of 11 seconds between signal pulses. This is further illustrated in FIG. 5, which shows a time sequence of pulses generated in the sensor signal Ss during operation of the cleaning system 2, where $\Delta T$ indicates the time interval between full patterns, and $\Delta t$ indicates the time interval between individual hits on the ring sensor 34. Clearly, the ring sensor 34 enables earlier and more reliable detection of malfunction in the operation of the cleaning system 2. The ring sensor 34 also provides more detailed information about the progress of the cleaning process. It should be noted that FIG. 5 illustrates a principal example of a sequence of pulses. In practice, depending on e.g. sensor type and whether signal processing is applied or not, the signal value and signal profile for each pulse may vary slightly.

As indicated in FIG. 4, the ring sensor 34 provides the added advantage that the jets will impinge on the ring sensor 34 for a longer time compared to the conventional sensor P. This fact may be used to improve the ability of the processing unit 30 to identify the signal pulses in the sensor signal Ss. Even if the hit would result in a comparatively weak signal pulse in the sensor signal, this signal pulse will generally have a longer duration than signal pulses acquired from a conventional sensor P and may thus be subjected to dedicated signal enhancement, such as time averaging, filtering etc.

Figure 6A:
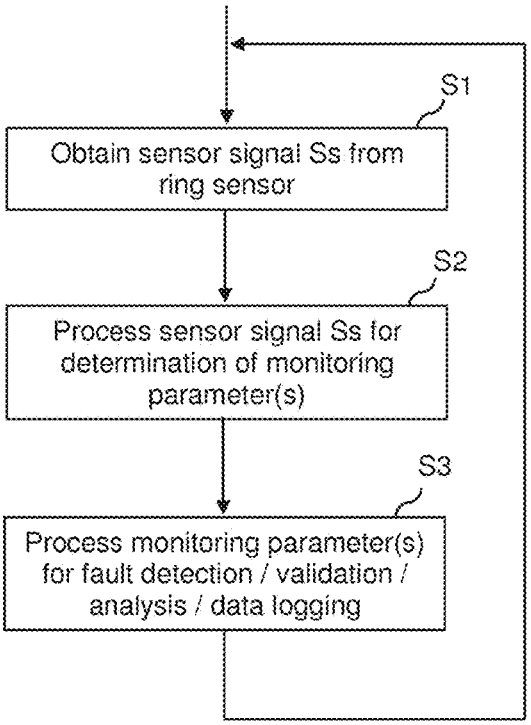
FIG. 6A is a flow chart of a monitoring process performed in the system of FIG. 1.

FIG. 6A is a flow chart of an embodiment of a process for monitoring the operation of the cleaning system of FIG. 1, based on the sensor signal Ss from the ring sensor 34. The process is typically automated and operates by repeatedly executing a sequence of steps S1-S3. In the example of FIG. 1, the monitoring process may be implemented by the processing unit 30. In step S1, the sensor signal Ss is obtained from the ring sensor 34. In step S2, the sensor signal Ss is processed for calculation of a value of one or more monitoring parameters, to be exemplified below. In step S3, the value of the monitoring parameter(s) is processed for a specific monitoring purpose, also to be exemplified below. It is realized that steps S1-S3 may be implemented in many different ways, all readily available to the skilled person. For example, steps S1-S3 may operate to acquire and process signal values within consecutive time windows of the sensor signal Ss, which time windows may or may not be overlapping in time. The processing in step S2 may be purely analog, purely digital, or a combination of analog and digital processing.

The sensor unit 33 may be based on any suitable sensor technology capable of sensing a liquid impact. Such sensor technology includes sensors for direct impact detection, such as various types of pressure sensors, as well as sensors for indirect impact detection, including electric conductivity sensors, liquid detection sensors, pH sensors, and temperature sensors. Pressure sensors may be based on any available technology, such as piezoresistive strain gauges, piezoelectric materials, capacitive detection, electromagnetic detection, optical detection, etc. It is also conceivable that sensing surface 34 is formed by a commercially available pressure sensitive film, e.g. of plastic material, of the type that is used in touch pads for computers.

The sensor ring 34 may define a unitary detection surface, such that the ring sensor 34 generates a signal pulse irrespective of the location of the impact on the sensing surface 34 (zero-dimensional detection). Such a ring sensor 34 may e.g. generate the train of signal pulses as shown in FIG. 5. In a variant, the sensor ring 34 may be provided with a spatial resolution in one or two dimensions, i.e. the sensor signal Ss not only indicates that a jet has hit the ring sensor 34 but also where this happened. A one-dimensional (1D) spatial resolution may be provided along the ring sensor 34 (in direction $\varphi$ in FIG. 4), making it possible to identify the location and/or extent of the jet. A two-dimensional (2D) spatial resolution of the ring sensor 34 will enable a full evaluation of the extent and path of each jet as it traverses the ring sensor 34. The use of spatial resolution may not only enable determination of more advanced monitoring parameters, but also improve the ability to identify/suppress interferences caused by liquid splashes, etc.

It is realized that, depending on the implementation of the ring sensor 34, a number of different monitoring parameters may be determined in step S2, including:

- the timing ($t_i$) of individual impacts on the sensing surface
- the spatial width ($\Delta s_i$) of individual impacts on the sensing surface
- the duration ($\delta t_1$) of individual impacts on the sensing surface
- the location ($s_i$) of individual impacts on the sensing surface the number ($\Delta n$) of individual impacts during a given time period the time difference ($\Delta t_i$) between individual impacts the amount of pressure ($p_i$) for individual impacts on the sensing surface In one implementation, step S3 processes the current value of the monitoring parameter(s) generated in step S2 for detection of malfunctions in the cleaning system 2, e.g. by comparing the current value to a corresponding reference value that represents the predetermined pattern. The reference value have may been obtained by mathematical modeling of the cleaning system for the specific container, or it may be obtained in a dedicated calibration procedure (see below). To reduce the impact of the current value, step S3 may instead operate to detect the malfunction based on a time average, optionally weighted, of the most recent values of the monitoring parameter. The malfunction may include an impaired rotation (or lack of rotation) of the rotary head 106 or the rotary hub 110, a complete or partial clogging of one or more nozzles 112, and an inability of the pump 61 to supply an adequate amount of liquid to the cleaning system 2. In one example, the impaired rotation may be detected based on one of the monitoring parameters: $t_i$, $\Delta s_i$, $\delta t_i$, $s_i$, $\Delta n$ and $\Delta t_i$, or a combination thereof. In another example, a complete or partial clogging of a nozzle may be detected based on one of the monitoring parameters: $t_i$, $\Delta s_i$, $\delta t_i$, $s_i$, $\Delta n$, $\Delta t_i$ and $p_i$, or a combination thereof. A failure of the pump 61 may be monitored by aggregating (e.g. summing) $p_i$ for consecutive jets from different nozzles 112 and monitoring the aggregated value as a function of time. In the event that step S3 detects a malfunction, it may issue an audible alarm and/or a visual signal to alert the operator of the cleaning system, e.g. via the user interface 38 (FIG. 1).

In another implementation, step S3 processes the current value of the monitoring parameter(s) to verify that the container has been properly cleaned. This implementation is fully equivalent to the above-described detection of malfunction.

In another implementation, step S3 processes the monitoring parameter(s) to analyze the movement pattern of the jets inside the container. In one example, the monitoring parameter(s) are analyzed for the purpose of validating a cleaning process for a specific container. In another example, the monitoring parameter(s) are analyzed for the purpose of validating or improving a mathematical model of the cleaning process in the container. In yet another example, the monitoring parameter(s) are analyzed for determining their functional dependence on various control or design parameters, such as the pressure of the liquid, the type of liquid, the number of nozzles, the type of nozzles, the rotation speed of the rotary head 106 and/or the rotary hub 110, the size and configuration of the container, the placement of the cleaning system etc, for example for the purpose of optimizing the cleaning process.

In another implementation, step S3 stores the monitoring parameter(s) in electronic memory (e.g. 32 in FIG. 1), e.g. to provide a validation record of the cleaning process. The validation record may contain a time sequence of values of the monitoring parameter(s) and/or a time sequence of signal values in the sensor signal Ss. A validation record may be necessary to fulfill regulatory requirements, e.g. in the food and pharmaceutical industry.

In yet another implementation, step S3 is operated to generate the above-mentioned reference values during a calibration procedure and store the reference values in an electronic memory for subsequent access by the processing unit. The reference values may be given by monitoring parameter values that are computed during a cleaning process at well-controlled conditions in the container, or they may be given in by monitoring parameter values computed in a preceding cleaning process that was completed without any malfunctions.

The sensing surface 34 of the sensor unit 33 may be configured in many different ways while retaining at least some of the advantages of the ring sensor in FIG. 4. A few alternative embodiments are shown in FIGS. 7A-7E.

Figure 7A:
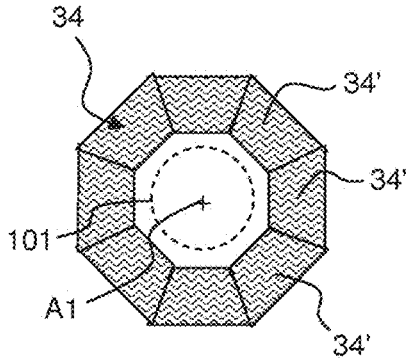
FIGS. 7A-7E are plan views of sensing surfaces according to various embodiments.
Figure 7B:
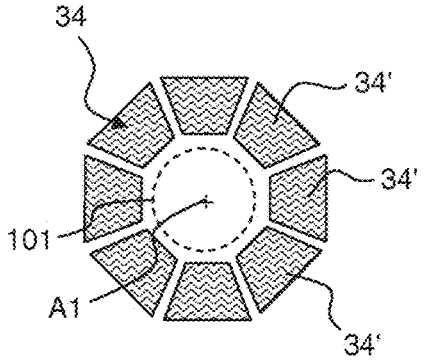

The embodiment in FIG. 7A defines a ring-shaped polygon surface 34 with essentially circular extent around the pipe 101. The surface 34 is formed by segments 34', which are shaped as trapezoids and formed side by side to surround the pipe 101. The segments 34 may be part of a unitary structure or they may be individual elements that are separately mounted to form the ring-shape as shown in FIG. 7A. The use of individual elements 34' may facilitate mounting of the sensor unit 33 in surrounding relationship to the pipe 101. Each segment 34' may or may not provide a spatial resolution within its extent. Even if the segments 34' are configured not to provide a spatial resolution per se, the resulting sensing surface 34 may provide a spatial resolution if each segment 34' is configured to generate a sub-signal Ss' indicative of liquid impact on the segment 34'. FIG. 7B is a variation of the embodiment in FIG. 7A, where the segments 34' are spaced from each other along the extent of the surface 34.

Figure 7C:
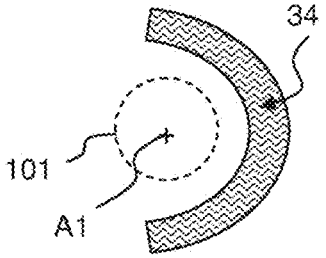

The embodiment in FIG. 7C defines an arc-shaped sensing surface 34, which may have an essentially circular extent, as shown, or a more ellipsoid extent, depending on implementation. In the illustrated example, the arc extends along approximately 50% of the perimeter of the pipe 101. It is realized that the sensing surface 34 will be hit by a significant number of jets during a full pattern, enabling early and reliable detection of malfunctions. The shape of the sensing surface 34 also enables a significant duration of many jets on the sensing surface 34.

Figure 7D:
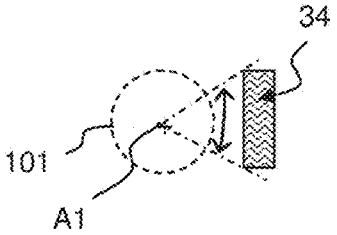

The embodiment in FIG. 7D defines a linear sensing surface 34, which extends along approximately 45°, i.e. 25%, of the perimeter of the pipe 101, as indicated by the double ended arrow. Compared to the conventional sensor (P in FIG. 4) the number of impinging jets is increased as well as the duration of the impacts.

Figure 7E:
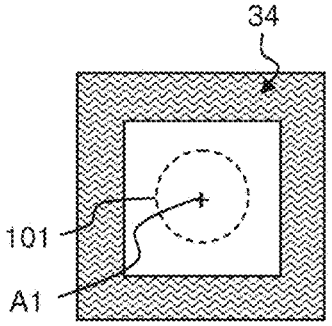

The embodiment of FIG. 7E has a ring-shaped polygon surface 34 with a rectangular extent around the pipe 101.

It is realized that any of the embodiment in FIGS. 7C-7E may comprise segments similar to the segments 34' in FIGS. 7A-7B. The segments may have any suitable shape.

Figure 8:
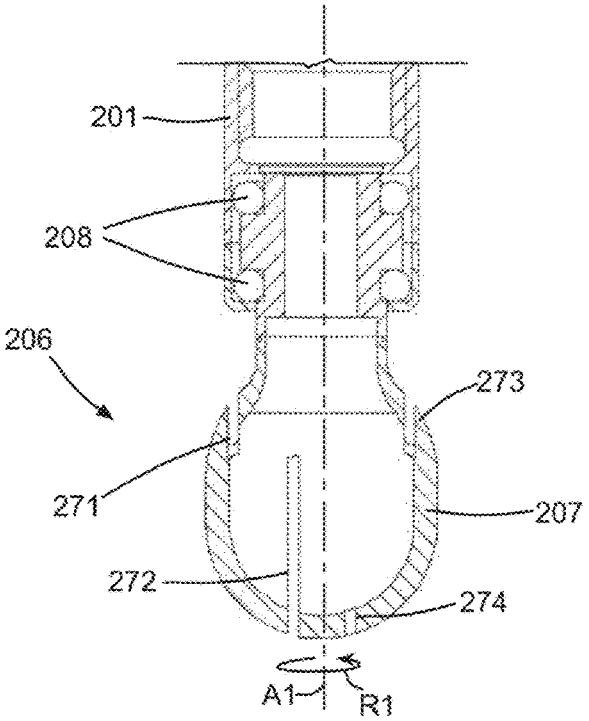
FIG. 8 is a section view of nozzle head for use in a cleaning system of RSH type.

FIG. 8 illustrates an embodiment of a rotary head 206 for use in a cleaning system of RSH type. The rotary head 206 is arranged at a lower end of a pipe 201 that may be similar to the pipe 101 of FIG. 1. The rotary head 206 comprises a ball-shaped body 207 that is connected to the pipe 201 via a bearing 208 that allows the rotary head 206 to rotate in a first direction R1 about an axis A1 that may be parallel (as shown) or inclined to the longitudinal axis of the pipe 201. Liquid enters the rotary head 206 from the pipe 210 and is ejected from the rotary head 206 via a number of slits 271-274 in the body 207. The slits 271-274 eject, in a conventional manner, the fluid in directions that effect a rotational movement of the rotary head 206, and, as known within the art, a predetermined flow of the liquid effects a predetermined rotational speed of the rotary head 206. From this follows that the slits 271-274 form a drive member that provides rotation of the rotary head 206 about the axis A1, such that liquid is ejected into the container in a predetermined pattern. The specific design illustrated in FIG. 8 generates sprays of so-called fan-shaped flat type, i.e. essentially planar sprays that diverge away from the respective slit 271-274 towards the walls of the container. Although not shown or discussed in further detail herein, there are also rotary spray heads that generate conical fan beams, i.e. beams that diverge three-dimensionally. There are also cleaning systems with a rotary head 206 of the type shown in FIG. 8 that generate one or more collimated jets instead of, or in addition to, fan beams.

Figure 9:
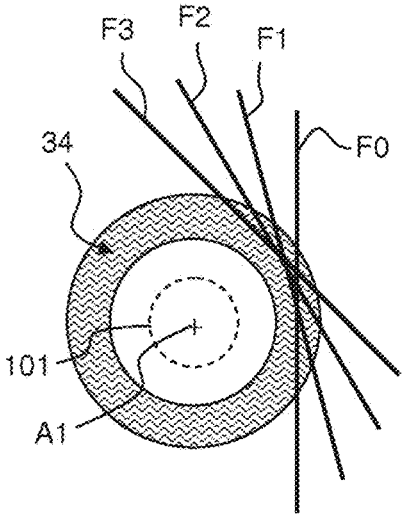
FIG. 9 is a plan view of a sensing surface according to an embodiment and indicates impact patterns on the sensing surface for a liquid spray generated by the nozzle head in FIG. 8.

FIG. 9 is a view that corresponds to FIG. 4 and illustrates approximate locations F0-F3 of a flat-type fan spray on the sensing surface 34 at four different time points during rotation of the rotary head 206. It is realized that the impact of the spray on the sensing surface 34 may be tracked via the resulting sensor signal. Depending on implementation of the sensing surface 34, proper rotation of the rotary head 206 may be verified by consistent presence of an impact on the sensing surface 34, if the sensing surface 34 has no spatial resolution, or by tracking the location of the impact along the sensing surface 34, if the sensing surface 34 has a spatial resolution. Furthermore, the spray fan pressure may be monitored via the amount of pressure on the sensing surface. It may also be possible to monitor the thickness of the fan spray via the transverse width of the impact on the sensing surface 34.

Figure 6B:
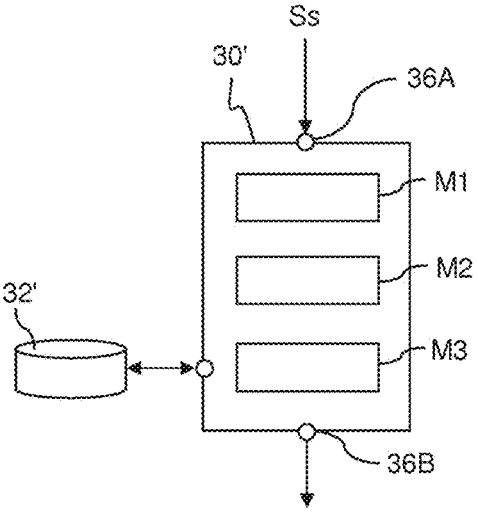
FIG. 6B is a block diagram of a device that implements the monitoring process in FIG. 6A.

Generally, the monitoring process according to the various embodiments disclosed herein may be implemented by a data processing device, such as the processing unit 30, which is connected to sample or otherwise acquire measurement values from the sensor unit 33. With reference to FIG. 1, the data processing device may be separate from the processing unit 30 that controls the operation of the cleaning system. FIG. 6B shows an example of a data processing device 30' configured to implement the monitoring process in FIG. 6A. The device 30' includes an input 36A for receiving the sensor signal Ss, which may or may not contain sub-signals Ss'. The device 30' further includes a data collection element (or means) M1 for obtaining signal values in the sensor signal Ss, a parameter generation element (or means) M2 for repeatedly generating a current value of one or more monitoring parameters, a processing element (or means) M3 for processing the current value for a specific monitoring purpose, and an output 36B for outputting data representative of the outcome of the monitoring. As indicated in FIG. 6B, the device 30' may be electrically connected to an electronic memory unit 32', e.g. for retrieval of reference values or storage of current values of monitoring parameters.

The device 30' may be implemented by special-purpose software (or firmware) run on one or more general-purpose or special-purpose computing devices. In this context, it is to be understood that each "element" or "means" of such a computing device refers to a conceptual equivalent of a method step; there is not always a one-to-one correspondence between elements/means and particular pieces of hardware or software routines. One piece of hardware sometimes comprises different means/elements. For example, a processing unit may serve as one element/means when executing one instruction, but serve as another element/means when executing another instruction. In addition, one element/means may be implemented by one instruction in some cases, but by a plurality of instructions in some other cases. Naturally, it is conceivable that one or more elements (means) are implemented entirely by analog hardware components.

The software controlled device 30' may include one or more processing units (cf. 31 in FIG. 1), e.g. a CPU ("Central Processing Unit"), a DSP ("Digital Signal Processor"), an ASIC ("Application-Specific Integrated Circuit"), discrete analog and/or digital components, or some other programmable logical device, such as an FPGA ("Field Programmable Gate Array"). The device 30' may further include a system memory and a system bus that couples various system components including the system memory to the processing unit. The system bus may be any of several types of bus structures including a memory bus or memory controller, a peripheral bus, and a local bus using any of a variety of bus architectures. The system memory may include computer storage media in the form of volatile and/or non-volatile memory such as read only memory (ROM), random access memory (RAM) and flash memory. The special-purpose software, the reference values, and any other data needed during execution, may be stored in the system memory, or on other removable/non-removable volatile/non-volatile computer storage media which is included in or accessible to the computing device, such as magnetic media, optical media, flash memory cards, digital tape, solid state RAM, solid state ROM, etc. The data processing device may include one or more communication interfaces, such as a serial interface, a parallel interface, a USB interface, a wireless interface, a network adapter, etc, as well as one or more data acquisition devices, such as an A/D converter. The special-purpose software may be provided to the device 30' on any suitable computer-readable medium, including a record medium, and a read-only memory.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

For example, the cleaning system may be mounted in an opening in any wall portion of the container to be cleaned, and the pipe may thus extend into the container in any desired direction. Further, the sensor unit need not be mounted on the cleaning system (e.g. in the mounting flange 102), but may instead be mounted directly in a wall portion of the container. It is also possible to use other types of RSH and RJH nozzle heads than those exemplified herein.

The invention claimed is:

1. A monitoring arrangement for a cleaning system installed in a container, the cleaning system comprising a pipe configured to extend into the container through a wall portion of the container, a nozzle head connected for rotation at an end of the pipe inside the container so as to eject a liquid, and a drive member operable to impart a rotation to the nozzle head around a first axis such that the liquid is ejected into the container in a predetermined patter, said monitoring arrangement comprising:

a sensor unit for mounting at the wall portion of the container, the sensor unit comprising a sensing surface responsive to liquid impact for enabling the sensor unit to emit a sensor signal indicative of the liquid impact, and a processing unit configured to obtain the sensor signal from the sensor unit and process the sensor signal for monitoring the operation of the cleaning system, wherein the sensing surface is elongated, meaning that the sensing surface has a greater dimension in one direction across the sensing surface than another dimension in another direction across the sensing surface, and is configured to extend along a perimeter of the pipe when the sensor unit is mounted at the wall portion of the container, the one direction and the other direction lying in a common plane.

2. The monitoring arrangement of claim 1, wherein the sensing surface is configured to extend along at least 25%, at least 50% or at least 75% of the perimeter of the pipe.

3. The monitoring arrangement of claim 1, the sensing surface is configured to surround the pipe when the sensor unit is mounted at the wall portion of the container.

4. The monitoring arrangement of claim 1, wherein the sensing surface is configured to extend along an essentially circular path around the pipe when the sensor unit is mounted at the wall portion of the container.

5. The monitoring arrangement of claim 1, wherein the sensing surface comprises individual segments, and wherein the sensor signal comprises sub-signals indicative of the liquid impact on the respective segments.

6. The monitoring arrangement of claim 1, wherein the processing unit is configured to process the sensor signal so as to identify occurrences of liquid impact on the sensing surface and match the occurrences to the predetermined pattern.

7. The monitoring arrangement of claim 1, wherein the sensor unit is configured to be responsive to the location of liquid impact within the sensing surface, and wherein the processing unit is configured to process the sensor signal to determine a distribution of liquid impact on the sensing surface.

8. The monitoring arrangement of claim 1, wherein the nozzle head of the cleaning system is configured to rotate at least two jets of liquid around the first axis and around a second axis of the nozzle head, wherein the processing unit is configured to monitor at least one of: a dimension of each jet, the number of jets, a pressure of each jet, the rotation of the jets around the first axis, and the rotation of the jets around the second axis.

9. The monitoring arrangement of claim 1, wherein the nozzle head of the cleaning system is configured to rotate at least one beam of liquid around the first axis, and wherein the processing unit is configured to monitor at least one of: a dimension of said at least one beam of liquid, the rotation of said at least one beam of liquid around the first axis, and a pressure of said at least one beam of liquid.

10. The monitoring arrangement of claim 1, wherein the processing unit is configured to process the sensor signal for determination of a value of at least one monitoring parameter Indicative of the ejected liquid, evaluate the value of said at least one monitoring parameter for detection of a malfunction in the cleaning system, and issue a warning signal indicative of the malfunction.

11. The monitoring arrangement of claim 1, wherein the processing unit is configured to record data representative of the predetermined pattern based on the sensing signal, and to generate a validation report based on the recorded data.

12. A cleaning system for installation in a container, wherein the cleaning system comprises a pipe configured to extend into the container through a wall portion of the container, a nozzle head connected for rotation at an end of the pipe inside the container so as to eject a liquid into the container, and at least one drive member operable to impart a rotation to the nozzle head around a first axis such that the liquid is ejected into the container in a predetermined patter, the cleaning system further comprising the monitoring arrangement of claim 1.

13. A monitoring arrangement for a cleaning system Installed in a container, the cleaning system comprising a pipe possessing a perimeter and configured to extend into the container through a wall portion of the container, a nozzle head connected for rotation at an end of the pipe inside the container so as to eject a liquid, and a drive member operable to impart a rotation to the nozzle head around a first axis such that the liquid is ejected into the container in a predetermined pattern, said monitoring arrangement comprising:

a sensor unit for mounting at the wall portion of the container, the sensor unit comprising a sensing surface responsive to liquid impact for enabling the sensor unit to emit a sensor signal indicative of the liquid impact, a processing unit configured to obtain the sensor signal from the sensor unit and process the sensor signal for monitoring the operation of the cleaning system, and the sensing surface being elongated as seen in plan view from inside the container when the sensor unit is mounted at the wall portion of the container.

14. The monitoring arrangement according to claim 13, wherein the elongated sensing surface is one of: i) an annular continuous sensing surface surrounding the perimeter of the pipe; ii) a plurality of trapezoid-shaped surface segments collectively forming a unitary ring-shaped polygon sensing surface; iii) a plurality of spaced-apart trapezoid-shaped surface segments collectively forming a ring-shaped polygon sensing surface; iv) an arc-shaped sensing surface; v) a linear sensing surface; and vi) a rectangular-shaped polygon sensing surface.

15. The monitoring arrangement according to claim 13, wherein the elongated sensing surface extends along at least 25% of the perimeter of the pipe when the sensor unit is mounted at the wall portion of the container.

16. A monitoring arrangement for a cleaning system installed in a container, the cleaning system comprising a pipe possessing a perimeter and configured to extend into the container through a wall portion of the container, a nozzle head connected for rotation at an end of the pipe inside the container so as to eject a liquid, and a drive member operable to impart a rotation to the nozzle head around a first axis such that the liquid is ejected into the container in a predetermined pattern, said monitoring arrangement comprising:

a sensor unit for mounting at the wall portion of the container, the sensor unit comprising a sensing surface responsive to liquid impact for enabling the sensor unit to emit a sensor signal indicative of the liquid impact, a processing unit configured to obtain the sensor signal from the sensor unit and process the sensor signal for monitoring the operation of the cleaning system, and the sensing surface being elongated, as seen in plan view from inside the container when the sensor unit is mounted at the wall portion of the container, and extending along at least 25% of the perimeter of the pipe when the sensor unit is mounted at the wall portion of the container.

17. The monitoring arrangement according to claim 16, wherein the elongated sensing surface is one of: i) an annular continuous sensing surface surrounding the perimeter of the pipe; ii) a plurality of trapezoid-shaped surface segments collectively forming a unitary ring-shaped polygon sensing surface; iii) a plurality of spaced-apart trapezoid-shaped surface segments collectively forming a ring-shaped polygon sensing surface; iv) an arc-shaped sensing surface; v) a linear sensing surface; and vi) a rectangular-shaped polygon sensing surface.

* * * * *